US009452333B1

(12) United States Patent
Chalifoux

(10) Patent No.: US 9,452,333 B1
(45) Date of Patent: Sep. 27, 2016

(54) COMPRESSION INTERCHANGEABLE GOLF GRIP

(71) Applicant: Paul Chalifoux, Naples, FL (US)

(72) Inventor: Paul Chalifoux, Naples, FL (US)

( * ) Notice: Subject to any disclaimer, the term of this patent is extended or adjusted under 35 U.S.C. 154(b) by 0 days.

(21) Appl. No.: 15/138,162

(22) Filed: Apr. 25, 2016

(51) Int. Cl.
*A63B 53/14* (2015.01)

(52) U.S. Cl.
CPC ..... *A63B 60/16* (2015.10); *A63B 53/14* (2013.01); *A63B 60/14* (2015.10)

(58) Field of Classification Search
CPC ..... A63B 60/16; A63B 53/14; A63B 60/14; A63B 60/22; A63B 60/28; A63B 60/30; A63B 60/06
See application file for complete search history.

(56) References Cited

U.S. PATENT DOCUMENTS 3,915,021 A * 10/1975 Schwartz ..... B23B 31/40 473/300
5,024,438 A * 6/1991 Candow ..... A63B 53/06 135/76
5,524,885 A * 6/1996 Heo ..... A63B 49/08 473/298
5,584,482 A * 12/1996 Huang ..... A63B 49/08 473/301
5,728,023 A * 3/1998 Green ..... F16G 1/22 474/206
6,656,057 B2 * 12/2003 Manual ..... A63B 53/14 473/300
6,837,812 B2 * 1/2005 Falone ..... B25G 1/01 2/267
7,118,598 B2 * 10/2006 Michelson ..... A61F 2/4455 623/17.11
7,806,600 B2 * 10/2010 Marrs ..... G02B 6/3802 385/55
8,177,658 B1 * 5/2012 Johnson ..... A63B 60/24 473/297
8,337,322 B2 * 12/2012 Harper ..... A63B 57/50 473/286
8,419,566 B2 * 4/2013 Gill ..... A63B 53/14 473/299
8,572,818 B2 * 11/2013 Hofmann ..... B60R 13/0206 24/297
2002/0022533 A1 * 2/2002 Churovich ..... A63B 53/14 473/296
2007/0111815 A1 * 5/2007 Cheng ..... A63B 53/10 473/300
2012/0142444 A1 * 6/2012 Chol ..... A63B 53/10 473/296
2013/0344977 A1 * 12/2013 Chalifoux ..... A63B 53/16 473/299
2015/0231462 A1 * 8/2015 Chapin ..... A63B 60/34 473/300

* cited by examiner

*Primary Examiner* — Stephen Blau

(57) ABSTRACT

An interchangeable golf grip secured by a snap compression unit that enters into a golf club shaft.

5 Claims, 11 Drawing Sheets

COMPRESSION INTERCHANGEABLE GOLF GRIP

BACKGROUND

1. Field of the Invention

The present invention refers to a method allowing quick placement and quick removal of golf grips onto a golf club. Quick change of golf grips allow golfers to try different golf grips on golf clubs before purchasing one. Quick change of golf grips further allows easy replacement of worn golf grips. Present methods to change a golf grip requires cutting off a golf grip, removing adhesive tape, reapplying adhesive tape, applying a slippery agent such as acetone and sliding on a new grip.

The present invention further allows perfect placement of a golf grip. If a golf grip is placed onto a golf club shaft and it is discovered to be misaligned, it is easily repositioned. It is further designed to allow different placement that makes a golf club longer or shorter.

2. Description of Concurrent Art

Golf grips aid a golfer in holding a golf club. Golf clubs include drivers, woods, irons, wedges and putters. Present grips come in a wide variety of sizes, shapes, colors, materials, textures, tapers, and the like. It is difficult to evaluate which grip fits a golfer's hand best and works best as a golfer cannot try them on a golf club and strike balls. Presently, a golfer evaluates how a grip feels in their hand with no golf club attached to the grip. If a golfer likes the feel of a grip in their hand, the grip is permanently attached to a club. If grips are attached to a golfer's clubs and they do not like them, it is an expensive and time consuming process to replace them.

Present technology to change a golf grip requires cutting off a golf grip, removing adhesive tape, reapplying adhesive tape, applying a slippery agent such as acetone and sliding on a new grip. The process is complex enough that most golfers do not change their own grips but have professionals do it for them. Professional regripping is expensive and time consuming. The process makes it difficult for a golfer to effectively evaluate grips.

It would be advantageous to have grips that simply slide onto a shaft and are secured with a simple turn of a component. It would be advantageous to have a technique that allows grips to be placed and removed in seconds for better selection at point of purchase and ease of replacement. It would be further advantageous for a golfer to be able to adjust a grips position as required to perfect alignment with the club head or adjust a club length.

The United States Golf Association, referred to as the USGA, has specific rules for golf equipment that a golfer must follow for use in tournaments and professional play. USGA rules define specifications for grip shape, size, position and the like. One of the USGA rules is that a golf club and its components cannot easily be adjusted by a golfer during play. To change or adjust components on golf equipment, a special tool is required to adhere to USGA rules. The present invention has unique features created specifically to follow these rules.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses are revealed for creating and utilizing compression techniques to secure golf grips and make them easily interchangeable.

The proposed golf grip includes a compression unit which enters into a golf club shaft. A golf grip is placed onto a golf club shaft such that a compression unit enters the shaft. When the compression unit is engaged, the grip is secured.

In the preferred embodiment, golf grips consist of a core which is surrounded by rubber, plastic or like materials to form a grip. The core is constructed of plastic, metal, rubber, ceramic, wood or any other common materials or combinations of materials. Outside materials form the individual shape, texture, color and the like.

The core fits over a golf club shaft. In the preferred embodiment, it expands over a shaft as it slides down to a final position. The core may be passive but in the preferred embodiment, it maintains constant compression onto a golf shaft. The resulting friction helps stabilize a grip.

The core is constructed inside a golf grip and is placed directly onto a golf shaft. Alternatively, core material is constructed inside a golf grip such that the core material does not touch the shaft. The core provides reinforcement to minimize bending of grip material.

Golf club shafts vary in diameter at the butt end. The butt end is 0.560, 0.580 or 0.600 inches. The diameter of a golf shaft changes going down toward the club head. In the preferred embodiment, the core expands to fit onto a shaft by material elasticity and or by core structural design.

In an alternative design, an internal support is placed within grip material and not exposed to the outside. It provides stiffness and resistance to movement. A compression unit inside a golf shaft transfers support to a grip through the core. A compression unit is joined to the core.

A golf grip expands during placement and remains expanded when fully placed. The inside of the golf grip is smaller than the outside diameter of a golf club shaft. The resulting compression provides resistance to movement. Friction onto a golf shaft resulting from grip compression provides resistance to movement. The golf grip fits securely with compression however; it is not secure enough that movement would not occur during use. The grip is fixed securely with a compression unit. Resistance from core compression is weak enough to allow grip placement. A grip is not secure enough to play golf without securing a compression unit. In one alternative, a weak restickable adhesive lines the inside of a core.

To augment grip stability, a compression component extends into a golf club shaft. The compression component is joined to the grip core. The compression component and core provide adequate force to secure a grip to a golf club.

The compression component includes a central hole that accepts a key component. The key component rotates to expand the compression component. The key component has an out of round lower rotational portion. Alternatively but not the preferred embodiment, a threaded screw is used.

In one embodiment, a screw is threaded down the center of the compression component. The screw continues downward striking an area of decrease diameter and forces it outward. Intense compression creates grip stability. To be USGA compliant, the screw strikes a ledge inside the compression component and forces it instantly outward. The compression unit releases the force of the screw striking the ledges by expanding outward. The rotational expansion creates a slight tipping of the ledge so the screw can continue past the ledge.

In the preferred embodiment for USGA approval, the central key component includes a lower out of round section and is placed inside the compression component. The compression component has a split lower section resulting in leg like extensions. Rotation of the central key component inside the compression component engages areas of decreased diameter. The areas of decreased diameter force the compression component legs outward. Expansion of the compression unit results in compression onto the inside wall of a golf club shaft. The compression unit is joined to the golf grip core resulting in a stabile golf grip.

In the preferred design, internal ramps force the key component to be in one of two positions. The key is either in an inactive or active compression position. The key cannot be at any position between active and inactive as forces do not allow enough stability. In the inactive position, the inner diameter of the compression unit is the same as the diameter of the key component. In the active position, the inner diameter of the compression unit is less than the diameter of the key component.

Ramps inside the compression unit force the key to slide into one position or the other. If the key goes half way up a ramp, forces return it to the inactive position. The key will be forced to the active position once it has progressed up the inactive ramp and goes over the hump to the active side. Effectively, the key snaps from one position to the other when engaging the ramps. In the preferred embodiment designed for USGA approval, the inner central key component is either in active or inactive compression. The amount of rotation can vary but in the preferred embodiment movement is ninety degrees.

The central key component is circular, oval, square, triangular, or like shapes in cross section to provide a snap like movement from one position to the other. The key varies in shape from top to bottom. The out of round portion may be at the top or the bottom of the key. Central portions of the key are usually round to allow controlled rotation. A special tool such as a hex Allen wrench engages the top of the key component. It provides a means to engage the central key component and transfer force for rotational movement.

As an example of use, a golfer wants to try different grips on a putter to determine which grip is most comfortable and allows them to golf best. A grip is placed onto a putter shaft by pressing it downward. The grip is secure enough from core compression to test putt without tightening the compression unit. The grip is removed and the next one placed. Several grips are quickly changed and tried to determine the best one. Once a decision has been reached, the compression unit is secured. Alternatively, a golfer may cement or adhere with adhesive tape the grip, though this is not preferred.

The present design further allows a golfer to position the grip fully or partially onto a golf club shaft effectively changing golf club length. The internal compression unit must be sufficiently in a golf club shaft to secure it however, as much as several inches change can be completed by design.

A golf club shaft diameter decreases as one moves down the shaft. The end of a golf grip has a matching smaller diameter to the point it will sit on a shaft. The grip core is split into sections at the end to allow expansion. When the end of a golf grip is placed onto a golf club shaft, it expands. The end of the core may have one or many splits for expansion. In the preferred embodiment, the end remains in compression for greater stability.

In the preferred embodiment, a core inside a grip has a long split starting from the top and extends part way down the core. Another split starts at the opposite end of the core in a different plane and goes part way up and passes the opposite split. This offset split construction minimizes movement and rotation while allowing expansion and maximum compression. Splits do not need to go to the end of the core to allow grip expansion.

An outside grip component is molded directly onto an inner core or manufactured separately and secured with adhesives, friction or like methods. Components can be constructed with various coatings or layers such as rubber.

The USGA, United States Golf Association, rules state that a golfer cannot adjust components on golf clubs during play. Present compression units revealed in previous patents provide controlled compression with threaded screws. A compression unit using screws can be tightened part way and create enough force to use the golf club but be adjustable. For example, a compression unit is tightened part way on a putter. It is turned 10 degrees. There is enough compression for a golfer to putt however; if enough hand force is applied to the grip, it can move and be adjusted. This is in violation of USGA rules. For this reason, the preferred embodiment of this invention uses a snap compression unit. When a threaded screw is used for the present invention, a flat ramp is placed for compression which limits partial tightening.

A key component turns inside a compression unit resulting in the expansion of the compression component inside a golf shaft. A snap component which is part of the compression unit, engages the key component. A ramp formed as a projection acts as a snap so when the inner component is turned, it cannot stay on the ramped areas. It must go past the projection to engage. It cannot stop part way and thus will be acceptable to USGA requirements. As an alternative, certain shapes such as a rounded rectangle shape simulates the ramp action though a projection is not seen.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile compression interchangeable golf grip system and series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which: Having thus described the system in general terms, reference will now be made to the accompanying drawings, which are not necessarily drawn to scale, and wherein.

DETAILED DESCRIPTION OF THE PREFERRED EMBODIMENTS

Figure 1:
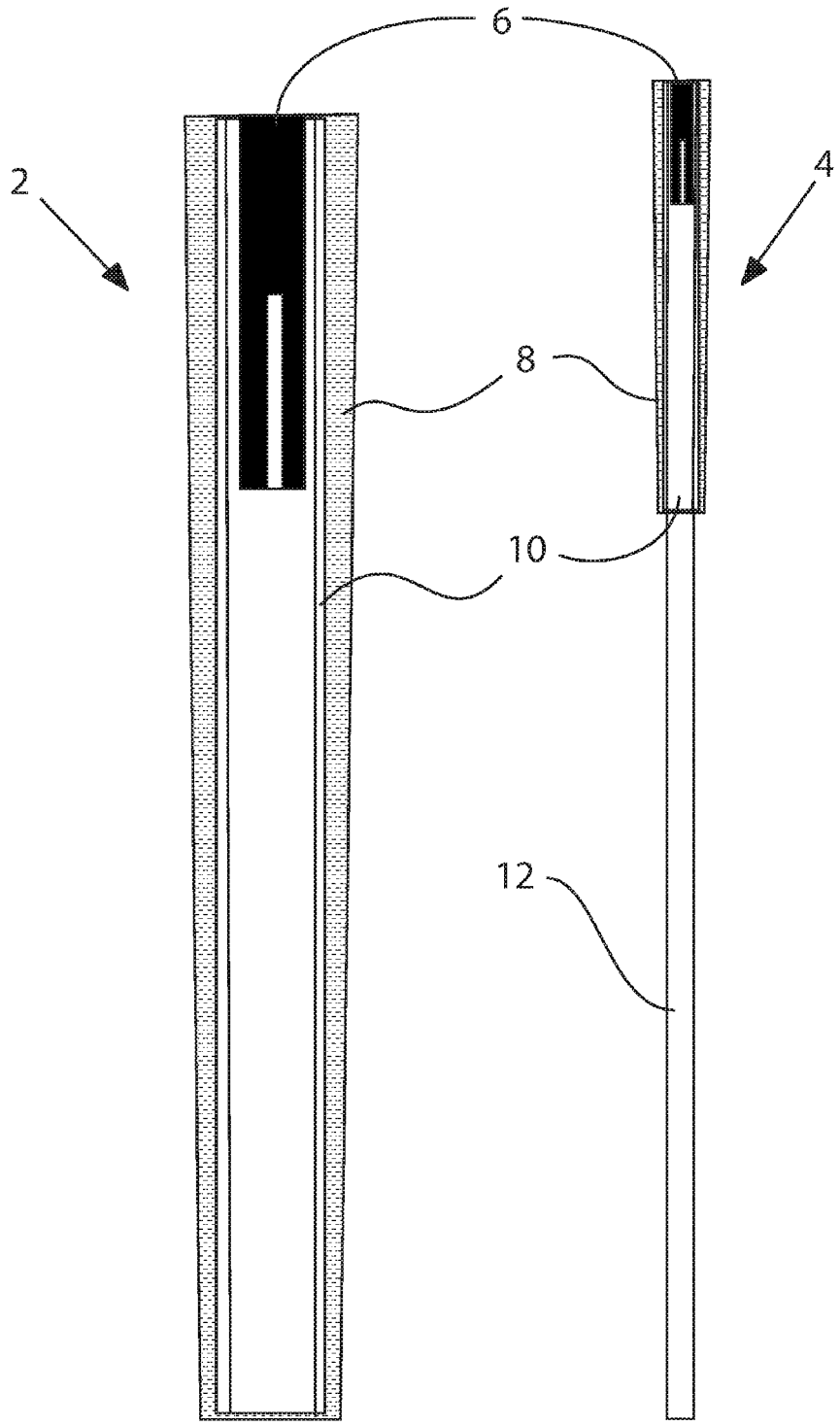
FIG. 1 illustrates a cross section view of the golf grip of this invention.

Referring to FIG. 1, compression grip 2 is seen mounted on a golf club shaft 12 as grip 4. The grip includes compression unit 6 that enters inside shaft 12 through the opening at the end, inner core 10 and outer rubber 8. Inner core 10 is constructed with slots or splits which allow it to expand over various shapes and diameters of a shaft. Putter shafts for example are parallel for the first 5 to 6 inches and then they either taper or decrease in size by steps. For a grip to fit tight at the lowest point which is part way down the shaft, it must expand over the top parallel segment and then fit securely onto the lower part of the shaft. Outer rubber 8 allows continuous pressure onto inner core 10 for a tight fit and resistance to movement. The can be constructed to be a slightly smaller diameter than the shaft to provide its own constant compression when seated.

In an alternative form, no core is required. A grip is constructed of a material that slides onto a golf club shaft. The grip is relatively solid to minimize rotation and movement. In the preferred embodiment, the grip provides constant compression on to a shaft. A compression unit is joined to said grip and supplies compression inside the golf shaft.

Figure 2:
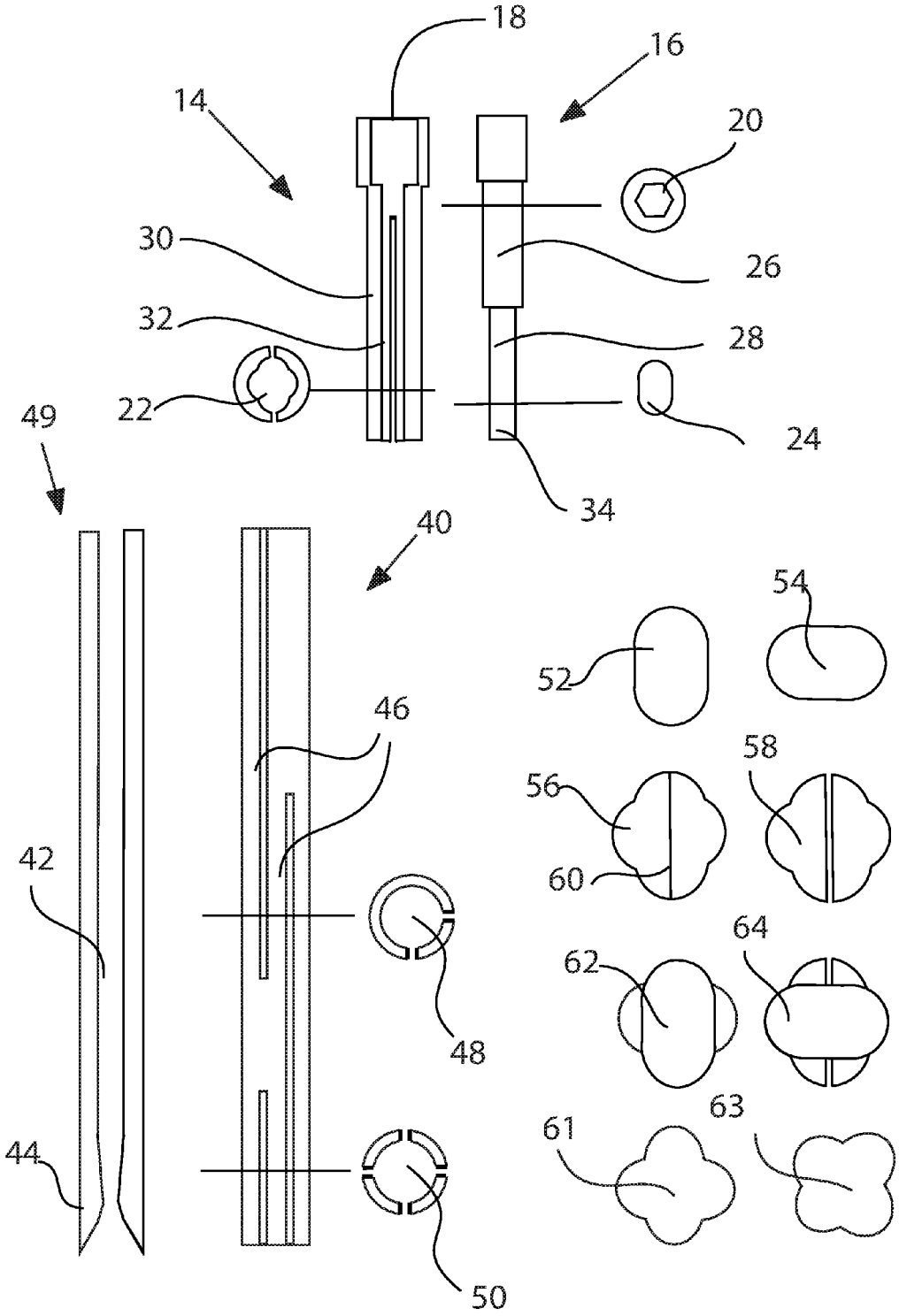
FIG. 2 illustrates cross section and isometric views of this invention.

Referring to FIG. 2, a compression unit enters into the open end of a golf club shaft. The compression unit of this invention consists of outer component 14 and inner component 16. Outer component 14 has lower segment 30 which is split by slot 32 to allow expansion. There is a hole running through outer component 14. The hole threw outer component 14 is shaped so there are different diameters as seen in cross section 22. In cross section 22, the vertical inside diameter is greater than the horizontal inside diameter. Expansion of lower segment 30 occurs when inner component 16 is rotated. Inner component 16 enters outer component 14 by placing end 34 into opening 18. There is a hex shaped hole in the top of inner component 16. Cross section 20 shows a hex shaped hole that accepts a hex Allen wrench in upper segment 26. Lower segment 28 has a slot shaped cross section 24. Section 26 is round keeping rotation stable in a matching round segment inside outer component 14. Rotation 90 degrees of inner component 16 in outer component 14 results in expansion of the sides of lower segment 30. The expansion occurs as a result of inner component 16 striking the decreased diameter of outer component 14.

Cross section 52 and 54 show inner component 16 positioned at 0 and 90 degrees rotation. Outer component cross section 56 is in a non-compression position. It is expanded to cross section 58 when the inner component is positioned as seen by cross section 52 rotated to 54. Cross section 62 and 64 show the inner and outer component cross sections together. Cross sections 61 and 63 are alternative inner component cross sections showing variations that can occur in position.

Inner core 49, shown in cross section, is the inside core of a grip. A golf shaft enters into space 42 from the bottom of the core and strikes ramps 44 expanding the grip. As a golf shaft is pressed into core 49, ramps 44 slowly open the grip diameter to allow placement. The inside diameter of core 49 at ramp 44 is significantly less than the upper diameter of a golf shaft. The inner diameter at ramp 44 must press against the shaft when fully placed. The diameter of the shaft decreases as one moves away from the butt end. For example, a golf shaft is 0.580 inches at the top and 0.500 inches or less eleven inches down the shaft.

Isometric view of core 40 shows slots 46. Cross sections 48 and 50 show slots that allow expansion of a grip during placement. Slots run the full length of the core, part way down or up the core or are intra-core not exiting the ends.

In the preferred embodiment, slots do not run the full length of core 40. In the preferred embodiment, they overlap in position. Overlapping allows expansion and provides improved rigidity to the core. There may be as few as two splits or as many as one hundred. A core flexes more if a slot or split runs the full length of a core.

In an alternative version, the shaft is split in half by two full length splits. The overlying rubber allows expansion while maintaining its position. Alternatively, one full length split is used. A cross section would show a C shape.

In the preferred embodiment, the grip has an inner diameter less than the outer diameter of a golf club shaft. A golf grip is always in compression onto the shaft to aid in stability.

Golf club length is changed by cutting off a piece of the shaft from the top or butt end. A golf grip is constructed at a fix length. Shaft diameter decreases going down. As more shaft material is removed to shorten a golf club, the smaller diameter a golf grip must be at its end to fit properly. The change in grip end diameter requirements is solved by grip expansion. For example, the grip end is 0.500 and expands to fit a shaft diameter of 0.520.

The top three to six inches of a golf shaft are parallel and therefore, the same diameter. The actual length is determined by how much is cut off during golf club length adjustment. For this reason, the preferred embodiment of this grip uses a core with internal parallel sides. The end of the grip narrows down to a smaller diameter to support the grip. The preferred embodiment uses internal protrusions or ramps at the end. It is possible the core will not touch the shaft for some distance in the middle of the grip. The grip core and grip materials are stiff enough to accommodate this.

For example, putter shafts are tapered or stepped down to a decreased diameter. For this reason, the preferred embodiment of this invention is a compression fit on the upper parallel segment and a stabilizing compression fit on the end. In more advanced versions, a controlled compression unit is used not shown here. The controlled compression unit would consist of a method to tighten the grip onto the shaft. The lower segment of a core can be tapered to aid in decreasing grip end diameter. The taper may be outside, inside or both.

Figure 3:
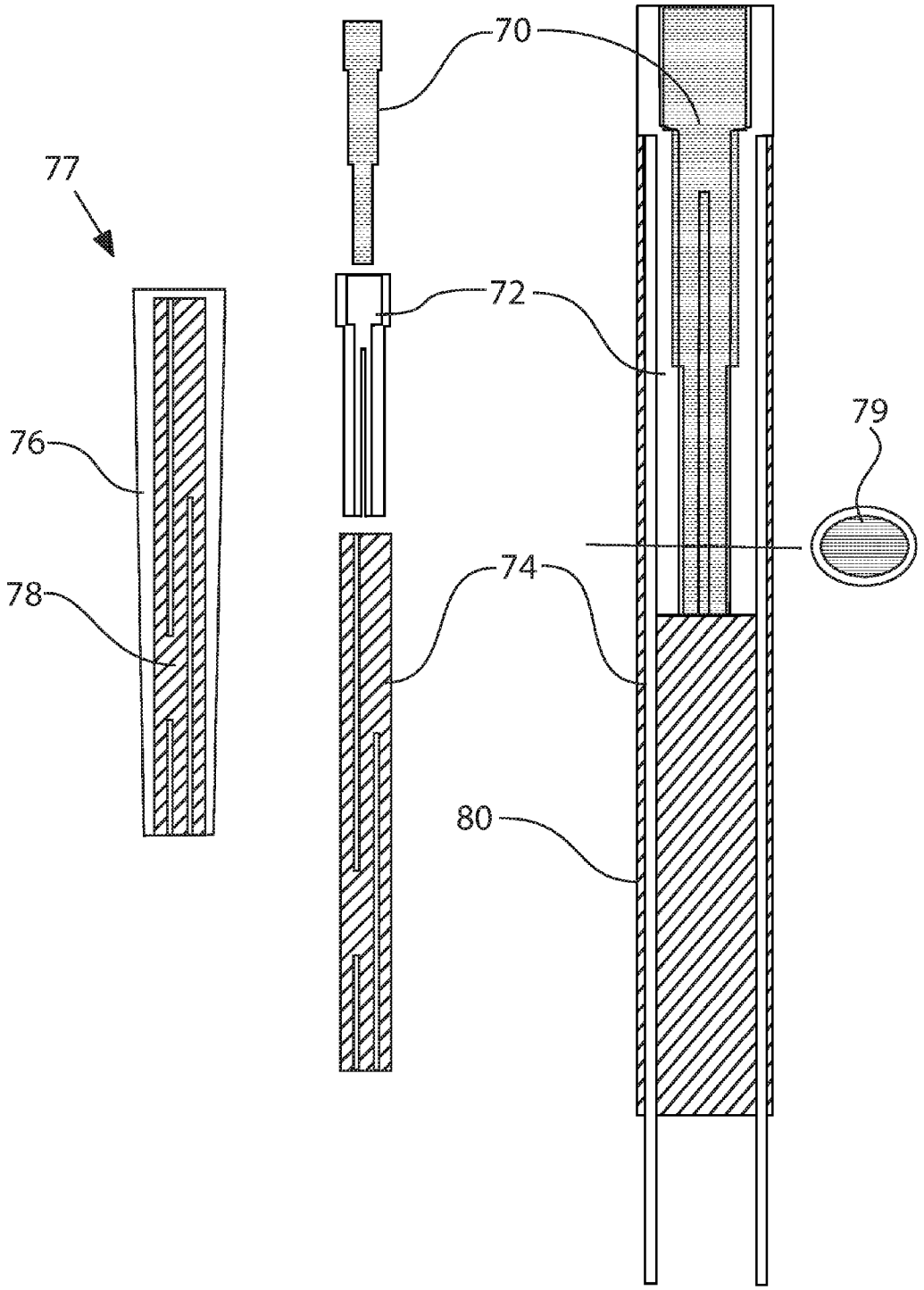
FIG. 3 illustrates cross section and isometric views of this invention.

Referring to FIG. 3, grip 77 consists of inner core 78 and outer rubber 76. The preferred embodiment is to use a core however; a solid grip with no core is an option of this invention. The grip must allow placement by sliding onto a shaft and be stiff enough to transfer stability from a compression unit that goes into a shaft. The compression unit inside the end of the grip consists of inner key component 70 that is placed inside outer component 72. Outer component 72 is positioned inside and joined to inner core 74. When assembled, shaft 80 is inside core 74 while compression component 72 is inside shaft 80. Cross section 79 reveals oval cross sections of components 70 and 72. Compression is produced when the inner component is rotated ninety degrees.

Figure 4:
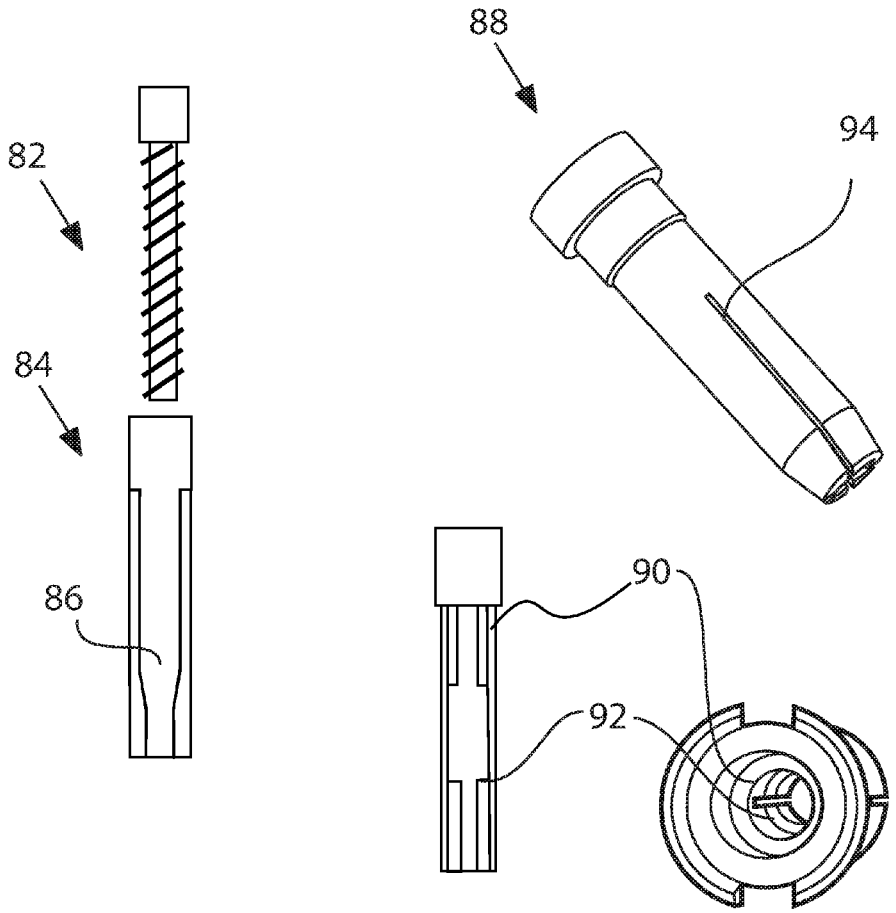
FIG. 4 illustrates isometric and cross section views of an alternative compression unit of this invention.

Referring to FIG. 4, a threaded screw 82 enters compression unit 84. As threaded unit 82 progresses downward, it strikes inclines 86 as seen in cross section view. This force results in expansion of a compression unit as seen in isometric view unit 88 with split 94. The compression unit 84 is not acceptable to the USGA. If the threaded screw is tightened part way it is considered adjustable during play.

In an alternative approach to make the unit acceptable to conform to USGA rules, upper portion 90 is threaded allowing engagement of a threaded screw. Portion 92 is a flat ledge or slightly inclined several degrees or less so engagement happens instantly with little turning motion of the threaded component. This configuration leaves very little room for variability in compression amounts. The grip is either loose or tight with minimal turn.

Figure 5:
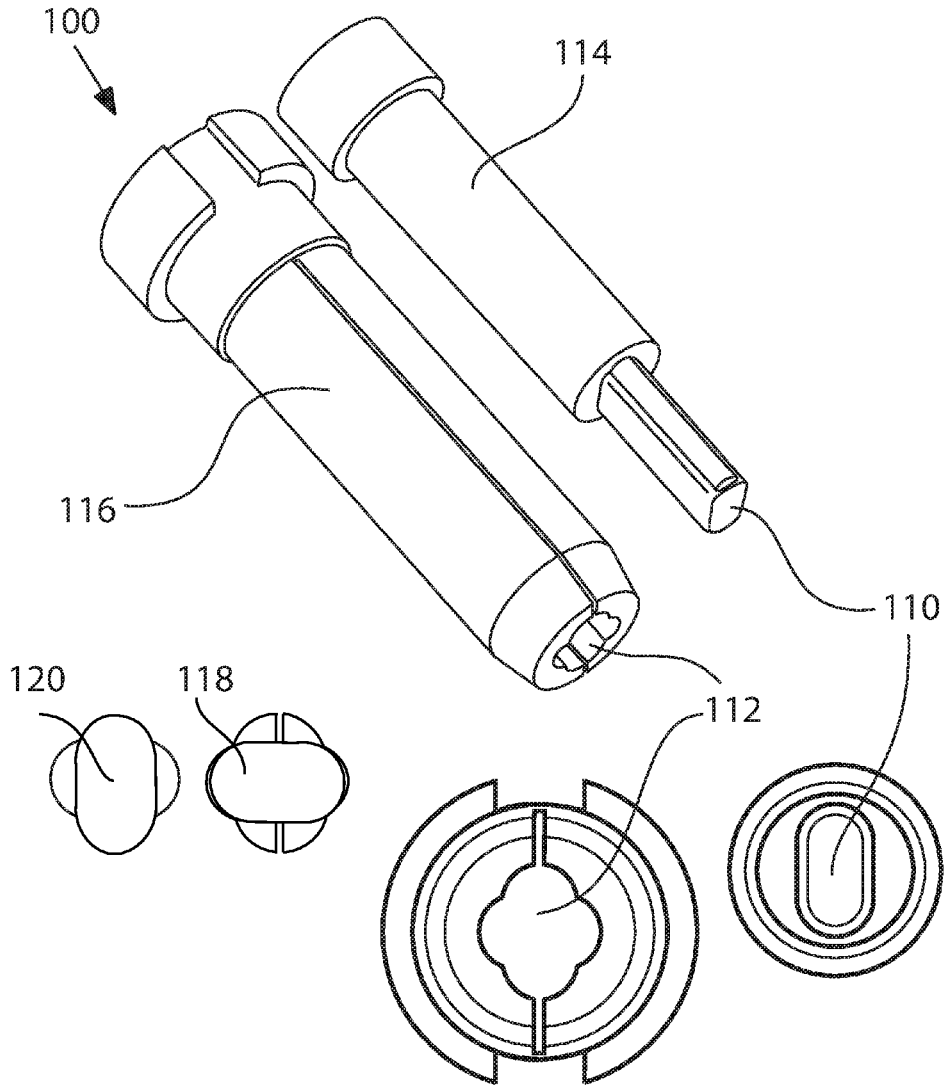
FIG. 5 illustrates an isometric view of an alternative compression unit of this invention.

Referring to FIG. 5, compression unit 100 has inner component 114 and outer component 116 which have end shapes 110 and 112. The horizontal diameter is less than the vertical diameter within the inside hole of outer component 116 as seen in 112. The vertical diameter as seen by end 112 is the same diameter and general dimensions as end section 110 of inner component 114. Rotation from vertical to horizontal of inner component 114 results in expansion of the lower segment of compression unit 116 as seen in vertical position 120 and horizontal position 118.

Figure 6:
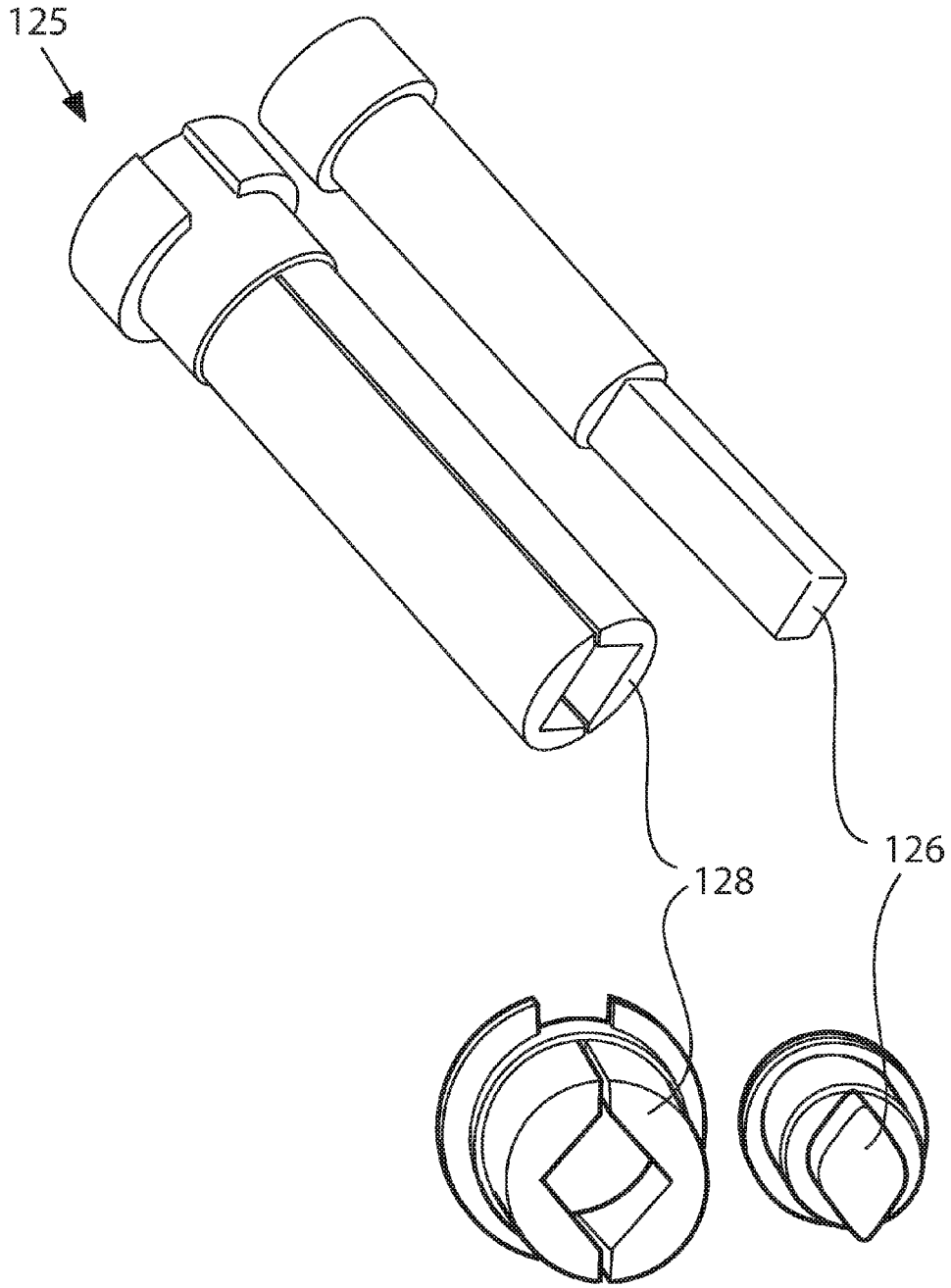
FIG. 6 illustrates an isometric view of an alternative compression unit of this invention.

Referring to FIG. 6, alternative compression unit 125 consists of inner component 126 and outer component 128. Inner component 126 rotates within outer component 128 resulting in expansion and compression onto a golf shaft inner wall. The lower segment of inner component 126 and the cross section of inner hole of compression unit 125 are more pointed/triangular in shape.

Figure 7:
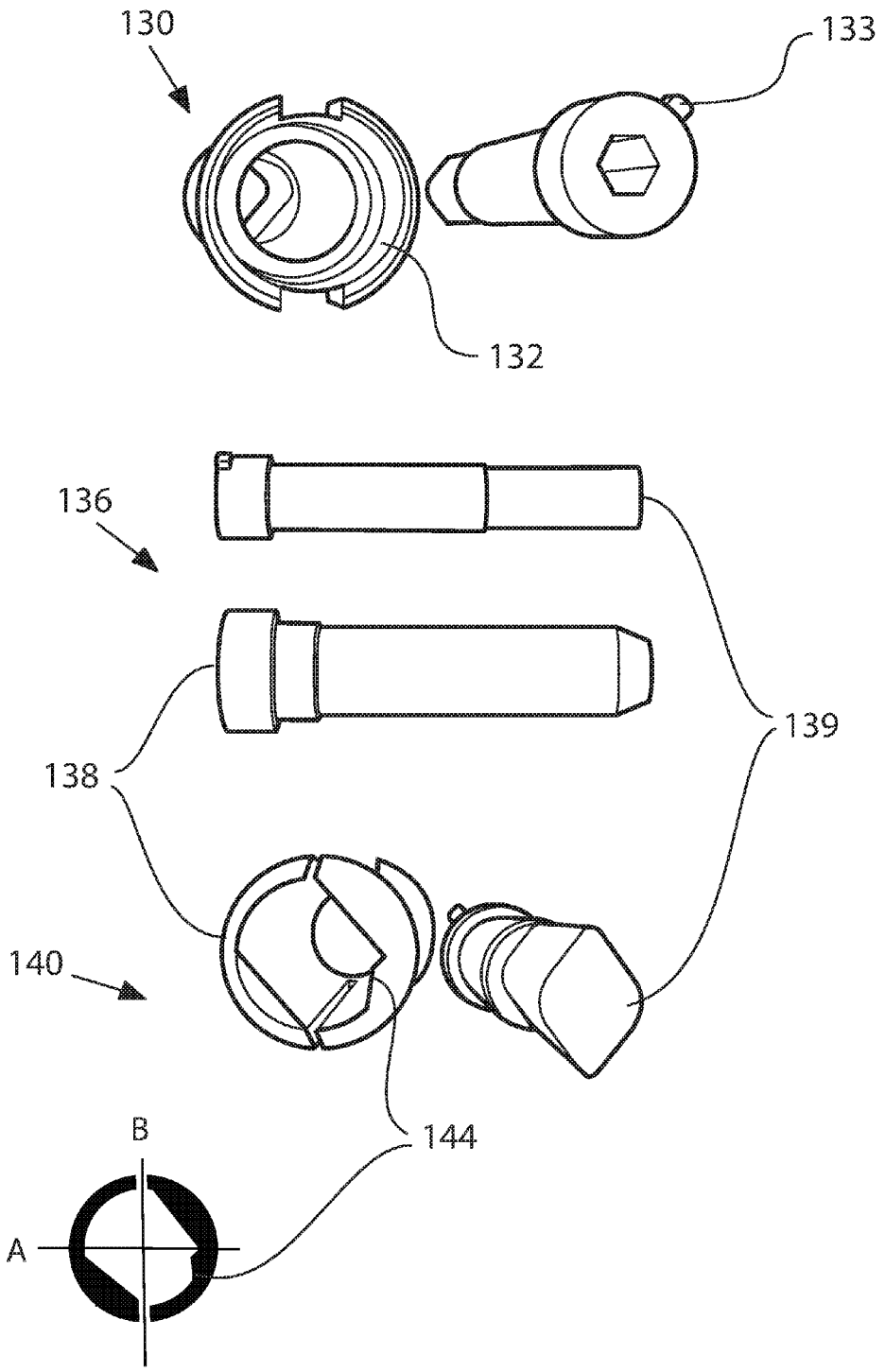
FIG. 7 illustrates an isometric view of an alternative of this invention.

Referring to FIG. 7, a self-limited movement and snap compression unit 130 is shown. The inner unit has extension 133 that moves within slot 132 of the outer unit. Rotation of the inner unit is limited by the extent of movement within slot 132. Compression unit 136/140 has inner unit 139 that rotates in outer unit 138. Outer unit 138 has internal projection 144 to cause a snap motion when inner unit 139 is rotated over it. When the inner unit is on one side of the snap, it is in compression and when it is on the other side of the projection, it is not. This allows for compression only on one side of a snap. Inner unit 139 cannot be located in an in between position for partial compression. Diameter B is larger than diameter A so position A provides compression while B does not.

Figure 8:
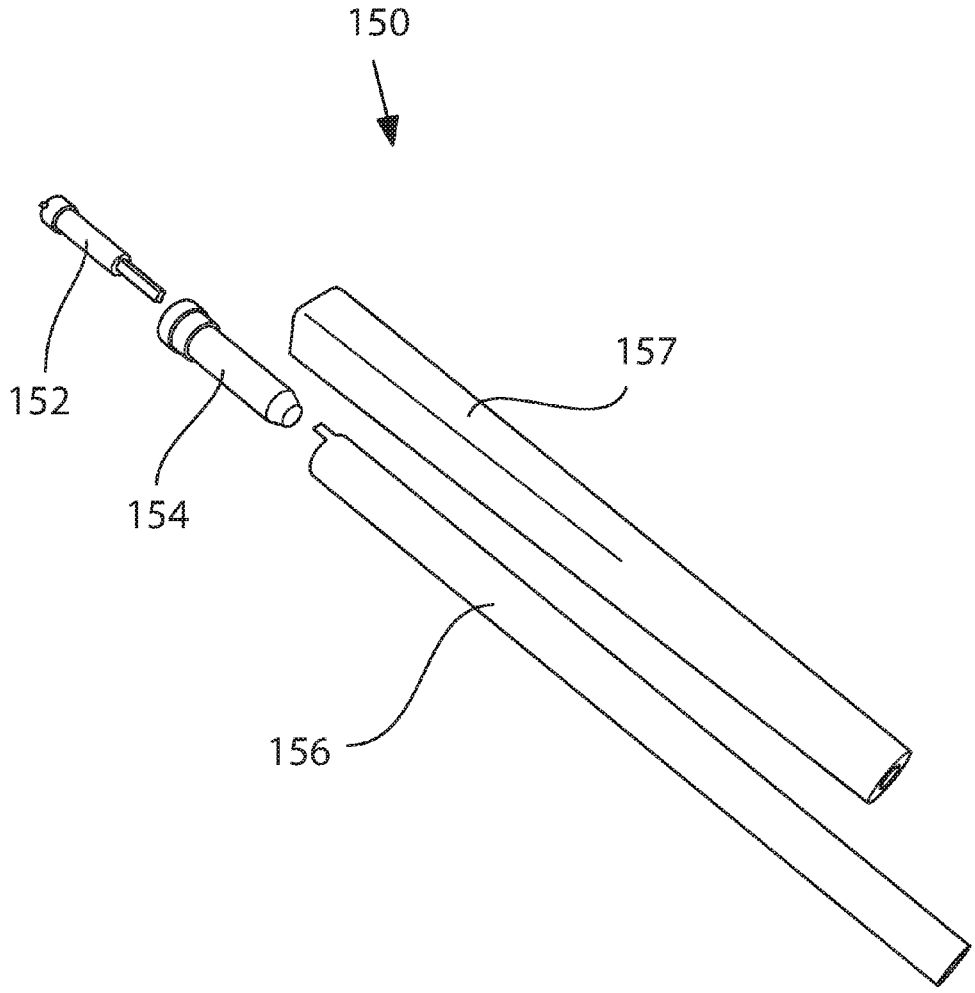
FIG. 8 illustrates an isometric view of all the components of this invention.
Figure 9:
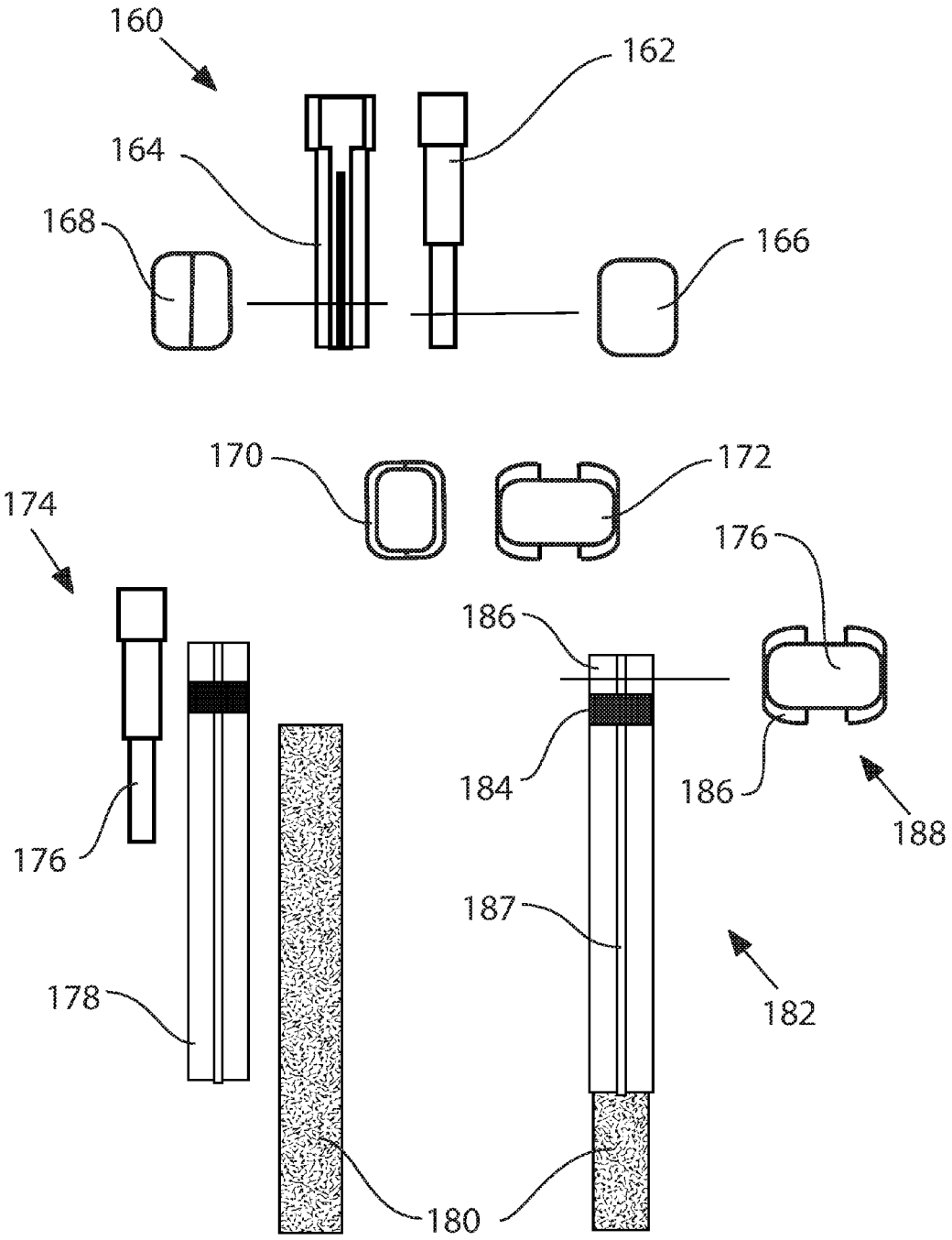
FIG. 9 illustrates an isometric and cross section view of alternative components of this invention.

Referring to FIG. 8, a full set of components for interchangeable grip 150 is shown including key compression unit 152, compression unit 154, grip core 156 and rubber grip 157. Each component fits into the other as a working unit. Unit 154 is joined to core 156 which are joined to grip 157. Unit 152 is free moving Referring to FIG. 9, compression unit 160 has outer unit 164 and inner key unit 162. Lower segment of outer unit 164 is split into two legs as seen in cross section 168. As few as two or as many as one hundred splits and legs may be used. Lower segment of key unit 162 is a rectangle shape as seen in cross section 166. When key 162 is in a matching position and general shape inside of outer unit 164, legs of outer unit 164 are together as seen in cross section 170. When inner key unit 162 is rotated ninety degrees inside outer unit 164, legs separate as seen in cross section 172. Separation of legs provides compression onto the inner walls of a shaft.

Alternative compression core 174 consists of inner unit 176 and outer core 178. Outer core 178 is placed onto the outside of golf shaft 180. As part of core 182, the upper section 186 has inner key unit 176 positioned inside it. When inner key unit 176 is rotated ninety degrees, it forces upper section 186 outward as seen in cross section 188. When area 186 is forced outward, it transfer force by fulcrum through solid area 184 to press lower segment 187 inward for retention and resistance to movement.

Figure 10:
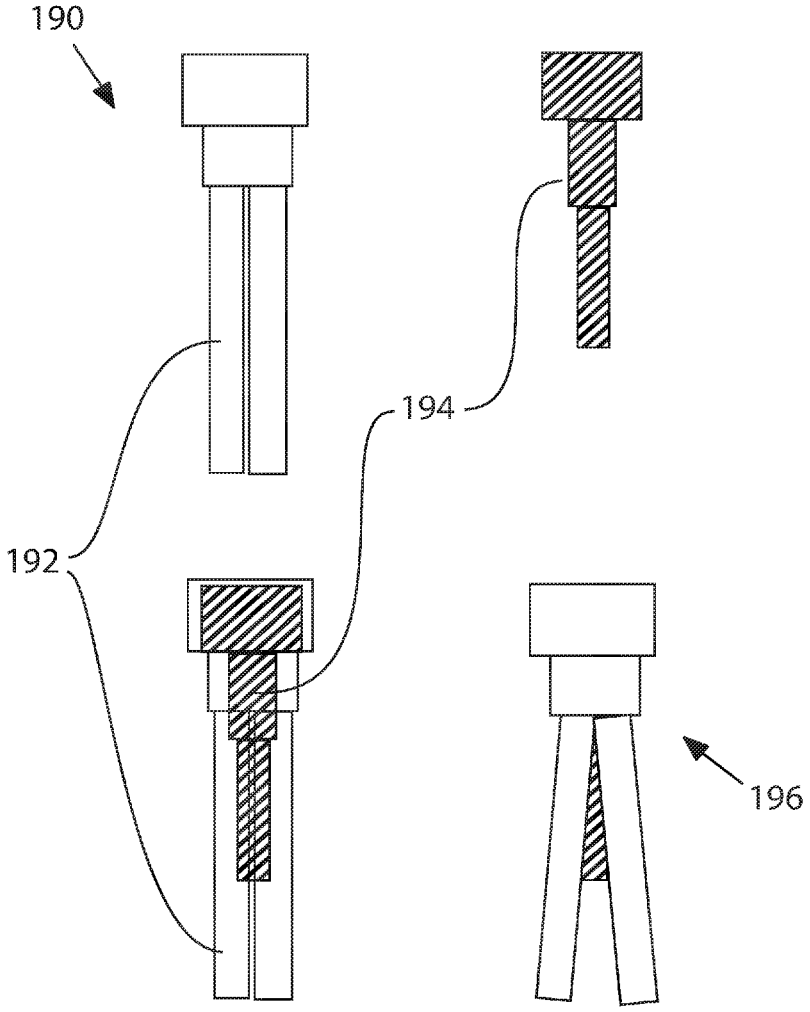
FIG. 10 illustrates an isometric view of the compression unit of this invention.

Referring to FIG. 10, compression unit 190 has outer unit 192 and inner key 194. Key 194 is shorter than outer unit 192 so when rotation occurs, legs of outer unit 194 pivot outward providing more surface area for resistance against inside golf shaft walls as seen in 196. When made of elastic materials, the legs bend to provide a large area of contact to the inside of a shaft.

Figure 11:
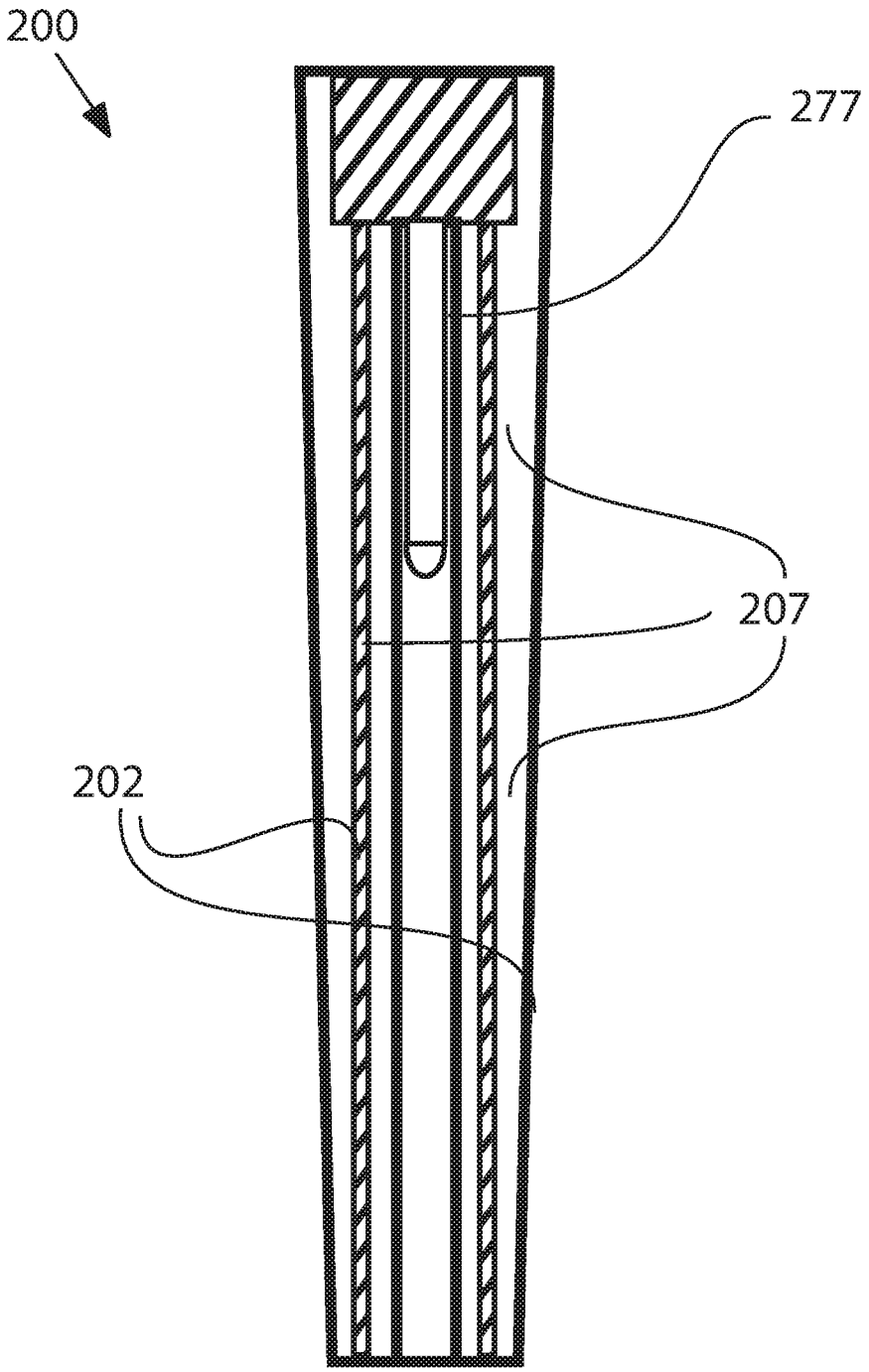
FIG. 11 illustrates a cross section view of an alternative grip and core of this invention.

Referring to FIG. 11, golf grip 200, has rubber portion 202, inner core 207 and compression unit 277 which is attached to inner core 207. Inner core 207 is surrounded by rubber 202 and does not have external exposure. It provides reinforcement to the grip to minimize rotation, movement, bending and the like.

The invention claimed is:

1. A golf club grip that includes:

a snap compression unit that enters into a golf club shaft comprises:

an inner component which is an internal key, and said internal key has a bottom section being out of round such that it is of greater diameter in one direction than another; and an outer component with a variable internal hole cross section, said internal hole cross section in a second direction is of the same or greater diameter than the greatest diameter of the said bottom section of said internal key and less than the greatest diameter of the said bottom section of said internal key in a different direction than the second direction, said variable internal hole cross section with a varying diameter results in expansion of the outer surface of the outer component and thus compression of the outer component when the outer surface contacts the inner wall of a shaft when said internal key is rotated, and said outer component has an inner wall with a ramp profile to create an expansion of the outer component as the greatest diameter of the said bottom section of said internal key moves along the ramp and a snap action between the internal key and outer component as the greatest diameter of the said bottom section of said internal key moves passed the ramp.

2. The golf grip of claim 1, wherein the internal key is turned 90 degrees to cause full compression.

3. The golf grip of claim 1, wherein the internal key is turned less than 90 degrees to cause full compression.

4. The golf grip of claim 1, wherein two outer layers are placed on the outer surface of a shaft, an inner layer of said two outer layers being a central core with a smaller inside diameter than an outer diameter of the shaft, and said central core expands during placement causing compression on the shaft.

5. The golf grip of claim 4, wherein said central core includes slots to allow expansion and said central core provides constant compression onto a shaft when in final position.

* * * * *